US011992071B2

(12) United States Patent
Peroglio

(10) Patent No.: US 11,992,071 B2
(45) Date of Patent: May 28, 2024

(54) CONVERTIBLE GARMENT

(71) Applicant: Paola Peroglio, Turin (IT)

(72) Inventor: Paola Peroglio, Turin (IT)

(73) Assignee: PEROGLIO PAOLA DITTA INDIVIDUAL (IT)

( * ) Notice: Subject to any disclaimer, the term of this patent is extended or adjusted under 35 U.S.C. 154(b) by 0 days.

(21) Appl. No.: 17/308,217

(22) Filed: May 5, 2021

(65) Prior Publication Data

US 2021/0345714 A1 Nov. 11, 2021

(30) Foreign Application Priority Data

May 5, 2020 (IT) ..... 102020000009940

(51) Int. Cl.
*A41D 15/00* (2006.01)
*A41D 1/06* (2006.01)

(52) U.S. Cl.
CPC ..... *A41D 15/002* (2013.01); *A41D 1/06* (2013.01)

(58) Field of Classification Search
CPC .... A41D 1/14; A41D 13/1254; A41D 15/005; A41D 15/00; A41D 15/02; A41D 1/21; A41F 9/00; A41F 9/025; A41F 1/004; A41F 9/02; A41F 9/002
USPC ..... 2/212, 213, 76, 219, 220, 221
See application file for complete search history.

(56) References Cited

U.S. PATENT DOCUMENTS 502,253 A * 7/1893 Harris ..... A41F 9/02 2/237
947,479 A * 1/1910 Cohn ..... A41D 1/21 2/221
1,104,185 A 7/1914 George
1,396,203 A 11/1921 Heinrich
1,966,861 A * 7/1934 Johnston ..... A41B 9/10 2/211
2,157,932 A * 5/1939 Eloise ..... A41D 1/21 2/221

(Continued)

FOREIGN PATENT DOCUMENTS

FR 2385345 10/1978

OTHER PUBLICATIONS

Search Report issued in counterpart European Application No. 21172328.3.

*Primary Examiner* — Katherine M Moran
*Assistant Examiner* — Grady Alexander Nunnery
(74) *Attorney, Agent, or Firm* — The Belles Group, P.C.

(57) ABSTRACT

A convertible garment is described suitable to cover at least part of a user's body and comprising: a shaped rear sheet and a shaped front sheet superimposable onto one another to define a configuration of the garment and each delimited by a lower edge, by an upper edge and by two lateral edges interposed between the lower edge and the upper edge; a belt element carried by one of the rear sheet and front sheet and configured to gird a portion of the user's body; first fastening elements carried by the belt element; and second fastening elements carried by the other of the rear sheet and front sheet and couplable with the first fastening elements to determine a superimposing position between end lateral portions of the rear sheet and corresponding end lateral portions (**3*d***) of the front sheet, each carrying one respective lateral edge; wherein the superimposed end lateral portions define respective lateral openings of the garment.

3 Claims, 11 Drawing Sheets

(56) References Cited

U.S. PATENT DOCUMENTS

| | | | | |
|---|---|---|---|---|
| 3,218,651 | A * | 11/1965 | Yesayan | A41D 15/00 2/105 |
| 2017/0135421 | A1 * | 5/2017 | Treyger | A41D 27/10 |

* cited by examiner

CONVERTIBLE GARMENT

CROSS-REFERENCE TO RELATED APPLICATIONS

This Patent Application claims priority from Italian Patent Application No. 102020000009940 filed on May 5, 2020, the entire disclosure of which is incorporated herein by reference.

TECHNICAL FIELD

The present invention relates to a garment of the convertible type configured to cover at least part, of a user's body, in particular a garment arrangeable in at least two configurations by means of different arrangement of the parts of which it is composed.

BACKGROUND

Convertible, or transformable, garments are known which can be arranged in different configurations by means of different combinations, that is dispositions, of the component parts of the garment.

In particular, garments are known which comprise a plurality of portions which are releasably couplable to each other and which can be removed or added to define different configurations of the garment.

For example, transformable trousers are known to comprise, generally at the leas, free end portions which ace releasably couplable with the rest of the trousers, typically by means of zips.

In this way, by removing or adding such free end portions arranged at the legs of the trousers, it is possible to provide for or arrange the trousers in a long trouser configuration and a short trouser configuration.

Transformable sweaters are also known, or in any case transformable dresses suitable to cover the upper part of the user's body, which use the same principle described above applied, in this case, to the sleeves. Thus, by removing or adding the free end portions of the sleeves, it is possible to switch between, i.e. it is possible to provide for or arrange the sweater in a long-sleeved configuration and a short-sleeved configuration.

Transformable garments of the type described above, including their removable parts, are in any case made in the traditional way, i.e. by sewing several parts or sheets together.

The market trend is known in the sector to simplify the process of making convertible garments, minimizing the packaging operations, for example by minimizing the number of seams necessary to join together the various parts of fabric that make up a garment, in order to increase the convertibility thereof.

OBJECT AND SUMMARY OF THE INVENTION

Aim of the present invention is to make a convertible garment which is highly reliable and of limited cost, and which allows to satisfy the requirement specified above and connected with convertible garments of a known type.

According to the invention, this object is achieved by a convertible garment as claimed in claim 1.

BRIEF DESCRIPTION OF THE DRAWINGS

For a better understanding of the present invention, some preferred non-limiting embodiments are described below, purely by way of example and with the aid of the attached drawings, in which.

DETAILED DESCRIPTION

With reference to FIGS. 1 to 9, number 1 indicates as a whole a convertible garment configured to cover at least part of a user's body.

For the purposes of this description, by convertible garment it is intended a garment arrangeable in at least two configurations by means of different disposition or combination of the parts of which it is composed.

In accordance with the preferred, non-limiting embodiment described herein and shown in FIGS. 1 to 9, the garment 1 is defined by a skirt configured to cover a lower part of a user's body, in particular from the waist downwards.

In one embodiment, the skirt covers the body starting from a position higher than the user's waist.

The garment 1 comprises a shaped rear sheet 2, configured to cover at least a rear portion of said body part, and a shaped front sheet 3, configured to cover at least a front portion of the aforesaid body part.

The rear sheet 2 and the front sheet 3 are superimposable onto one another to define a configuration of the garment 1.

Figure 2:
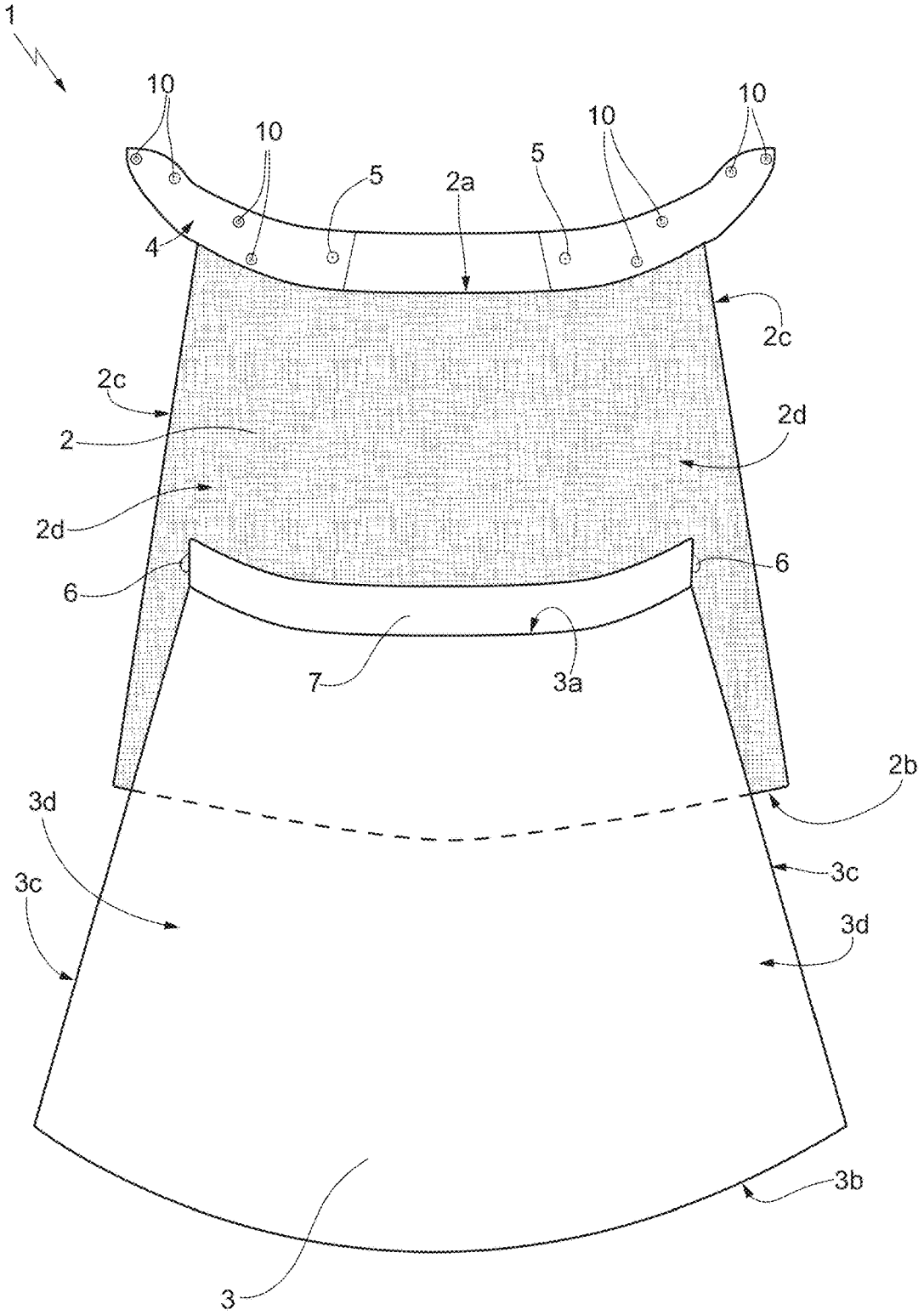
FIGS. 2 and 3 are frontal perspective views, with parts removed for clarity's sake, showing steps of a sequence of assembly of the convertible garment of FIG. 1.

As visible in FIG. 2, the rear sheet 2 is delimited by an upper edge 2*a*, by a lower edge 2*b* and by two lateral edges 2*c* interposed between the lower edge 2*b* and the upper edge 2*a*.

The front sheet 3 is delimited by an upper edge 3*a*, by a lower edge 3*b* and by two lateral edges 3*c* between the lower edge 3*b* and the upper edge 3*a*.

It is also possible to identify two end lateral, portions 2*d* of the rear sheet 2, each carrying one respective lateral edge 2*c*, and two end lateral portions 3*d* of the front sheet 3, each carrying one respective lateral edge 3*c*.

It should be noted that, in the present description, the term "shaped" comprises any shape of the rear sheet 2 and front sheet 3 which enables a wearable garment to be made and/or assembled and/or manufactured. For example, the aforesaid sheets may be in the form of truncated cone lateral surfaces developed on a plane (FIG. 2), or rectangular, oval, or any other suitable shape. In particular, the lateral edges 2*c*, 3*c* can have a straight, broken, curved or mixed profile.

According to this embodiment, the rear sheet 2 and the front sheet 3 are composed of a single sheet, respectively.

Alternatively, the rear sheet 2 may be composed by joining, for example by sewing, a left rear half-sheet and a right rear half-sheet. Similarly, the front sheet 3 may be composed by joining, for example by sewing, a left front half-sheet and a right front half-sheet.

In an embodiment, the left rear half-sheet and the left front half-sheet are made as a single sheet, and the right rear half-sheet and the right front half-sheet, are made as a single sheet.

The garment 1 further comprises:

- a belt element 4 carried by one of the rear sheer 2 and front sheet 3, in particular by the rear sheet 2, and configured to gird a portion of the user's body, for example the waist;
- first fastening element, preferably buttons 5, carried by the belt element 4; and
- second fastening elements, preferably eyelets 6, carried on the other side of the rear sheet 2 and front sheet 3, in particular by the front sheet 3, and couplable with the buttons 5 to determine a superimposing position between the end lateral portions 2*d* of the rear sheet 2 and the end lateral portions 3*d* of the front sheet 3.

In particular, the belt element 4 is fixed, in particular sewn, to the upper edge 2*a* of the rear sheet 2, so as to gird, in a closing condition, the aforesaid portion of the body, in particular the waist.

In addition, the eyelets 6 are fixed, in particular sewn, at the upper edge 3*a* of the front sheet 3.

More precisely, the eyelets 6 are carried by a second belt element 7 fixed, in particular sewn, to the upper edge 3*a* of the front, sheet 3 and configured to gird, at least partially, the same portion of the body girded by the belt element 4.

In more detail, the eyelets 6 are fixed to mutually opposite lateral edges of the belt element 7 and protrude from said edges.

The belt element 4 comprises releasable closing elements 10, in particular buttons or Velcro or poussoirs, configured to releasably fix the belt element 4 in a closing position wherein the belt element 4 girds the aforesaid portion of the body.

The superimposed end lateral portions 2*d*, 3*d* define respective lateral openings 3 of the garment 1.

In particular, at least in a closing condition of the belt element 4, the end lateral portions 2*d*, 3*d* are superimposed and decoupled from each other, so as to delimit said lateral openings 8 along a longitudinal direction of the garment 1.

It should be noted that the end lateral portions 2*d*, 3*d* may be in contact with each other, when superimposed, but not coupled (fixed) to each other.

In other words, by coupling the eyelets 6 with the buttons 5 (FIG. 3) a first superposition of the end lateral portions 2*d*, 3*d* is obtained.

Figure 1:
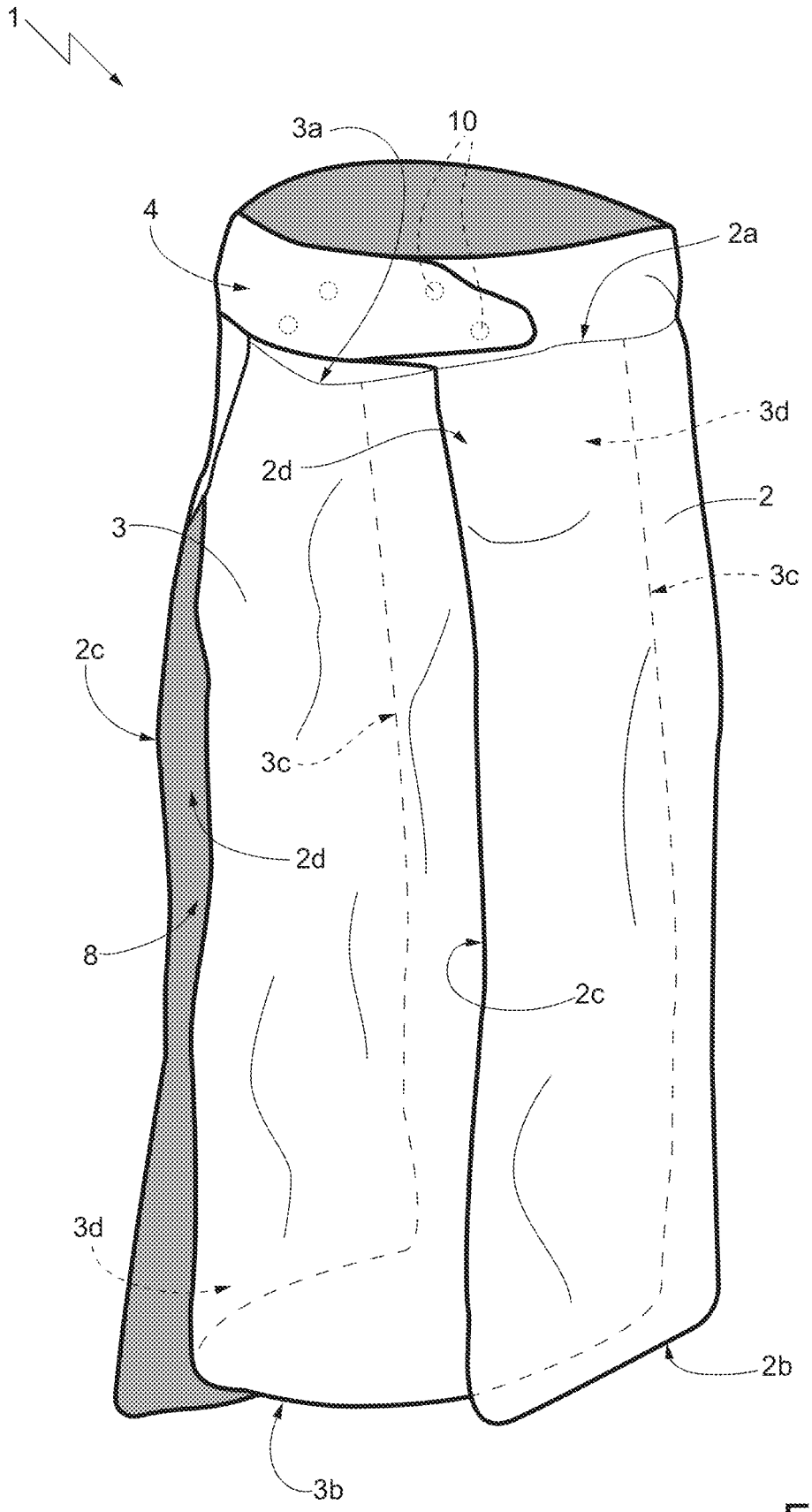
FIG. 1 is a perspective view of a convertible garment according to a first embodiment of the present invention and arranged in a first configuration.
Figure 3:
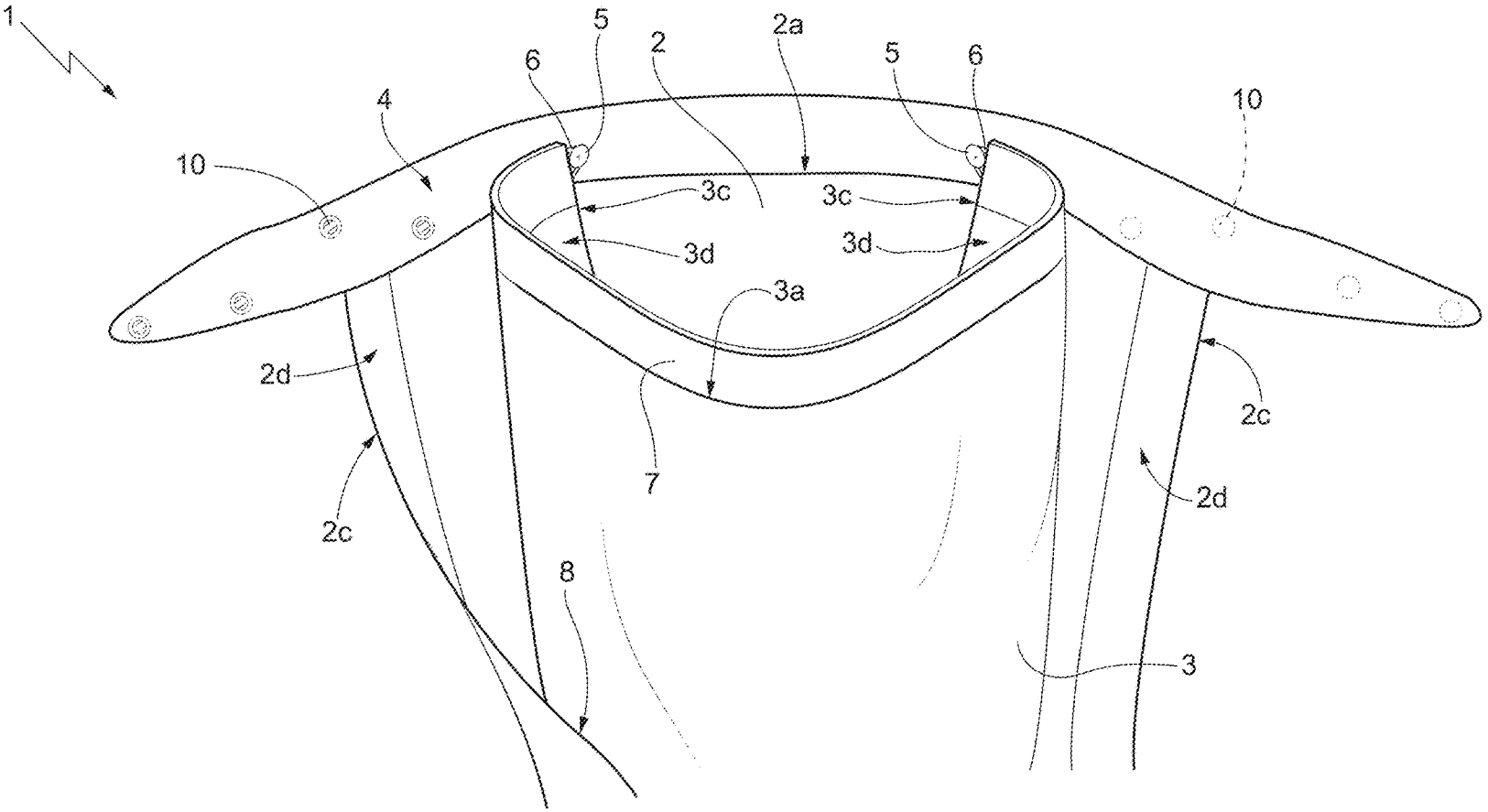

Subsequently, by closing the belt element 4, as shown in FIG. 3 until the configuration of FIG. 1 is achieved, the arrangement of the dress in a first configuration is obtained, wherein the rear sheet 2 wraps at least partially the front sheet 3 and wherein the end portions 2*d* are superimposed on (and therefore external with respect to) the end portions 3*d*.

In this way, the lateral openings 8 are defined. In practice, the garment 1 is open laterally. The configuration described above makes it possible to make a garment 1 by minimizing the manufacturing operations, without the need for further seams other than those used to make the single rear 2 and front 3 sheets.

Figure 4:
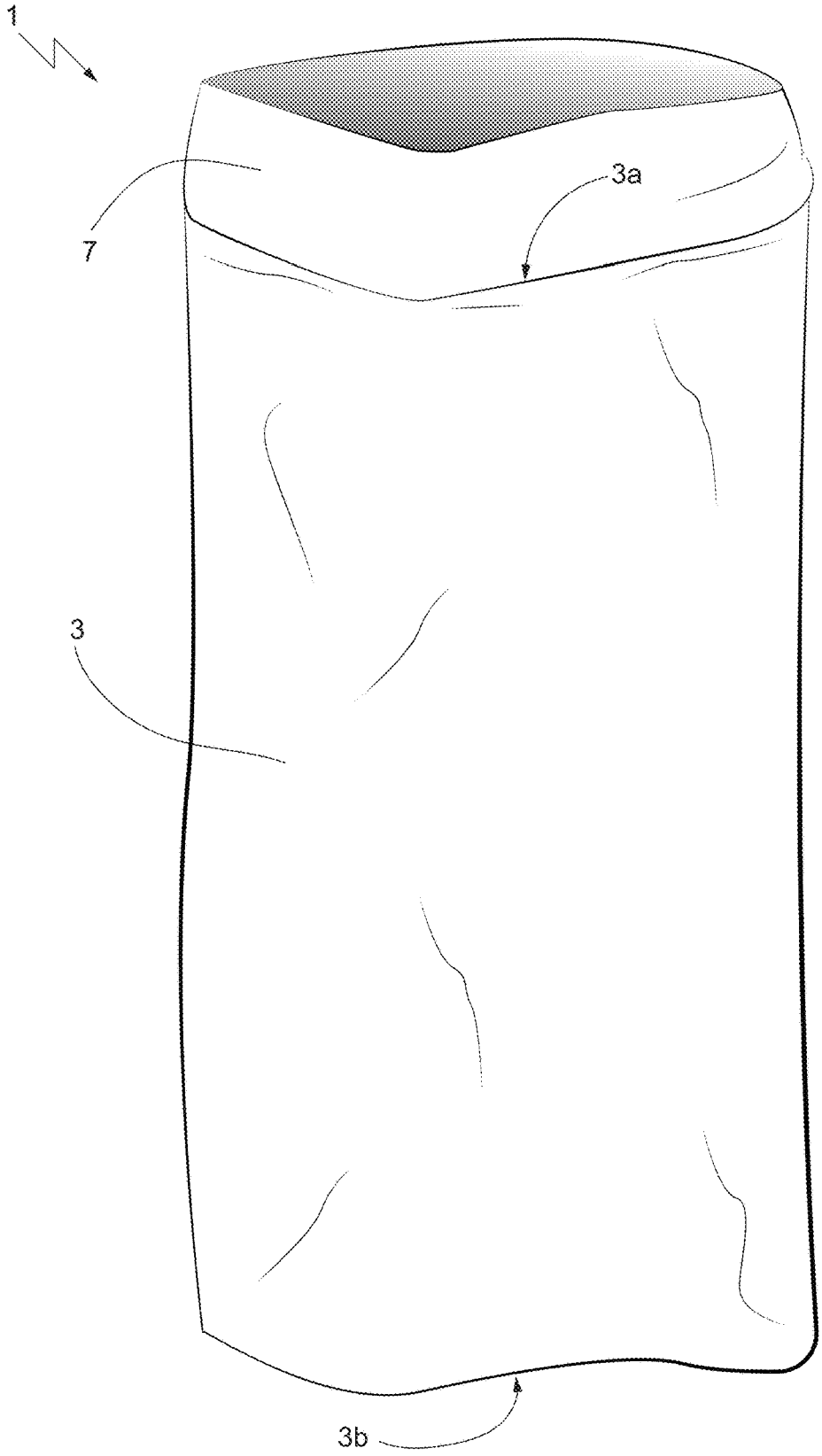
FIG. 4 is a perspective view of the convertible garment of FIG. 1 arranged m a second configuration.

FIG. 4 shows the garment 1 arranged in a second configuration different from the first configuration shown in FIGS. 1, 2 and 3.

In particular, in this second configuration, the front sheet 3 wraps partially the rear sheet 2.

Figure 8:
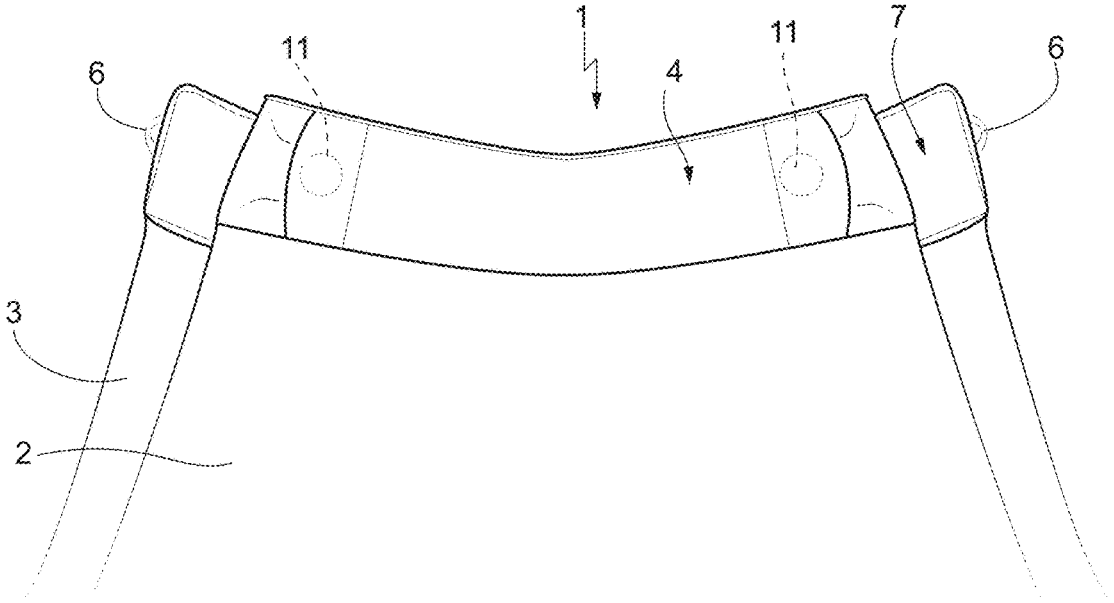
Figure 9:
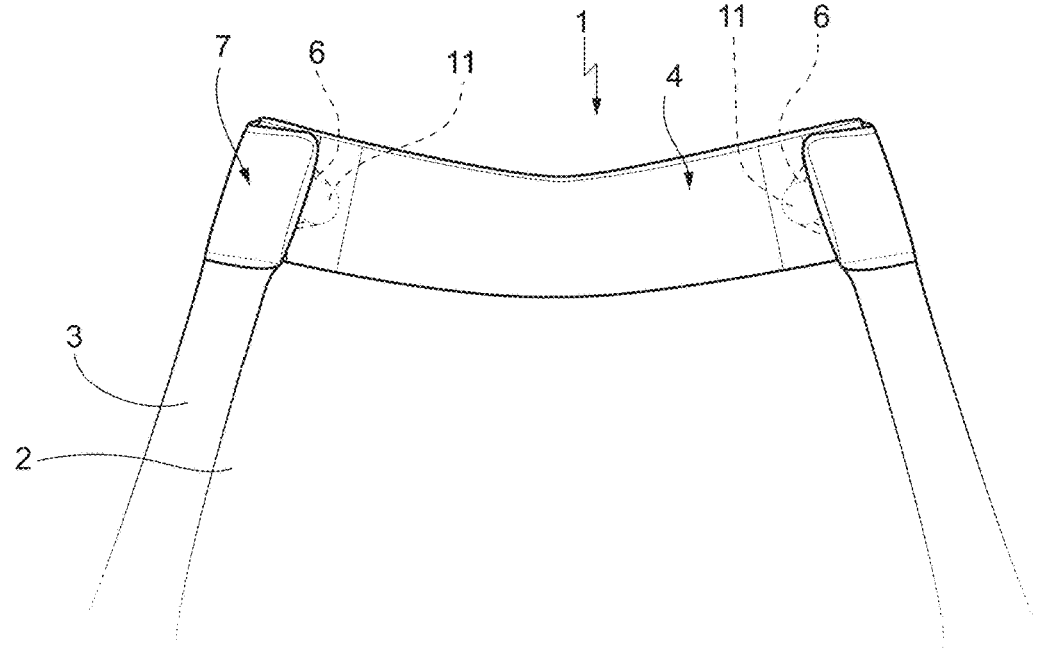
Figure 9A:
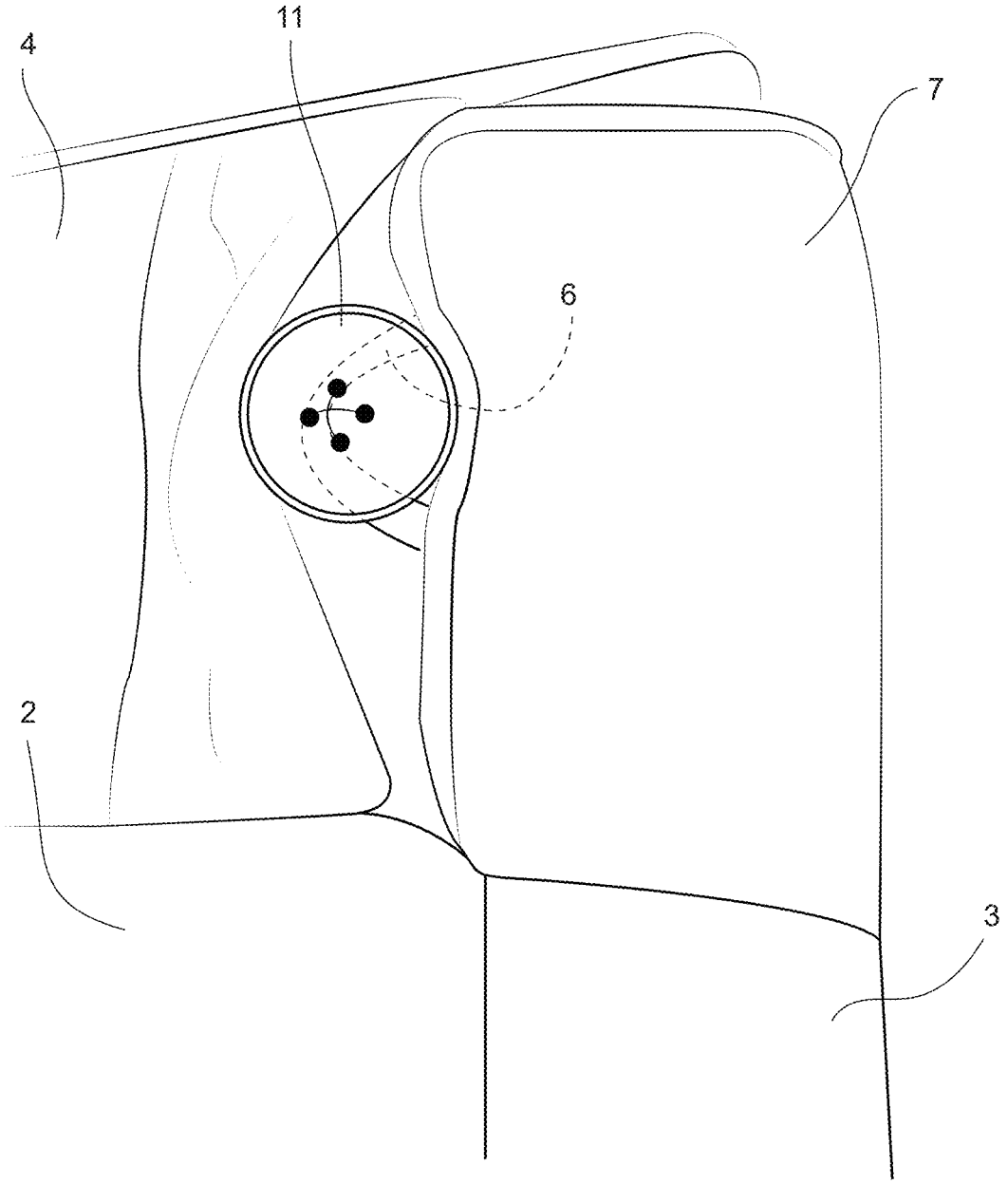
FIG. 9*a* shows a detail or the garment in FIG. 4.

For this purpose, as visible in detail in FIGS. 8, 9 and 9*a*, the garment 1 comprises third fastening elements, in particular buttons 11 carried by the belt element 4.

In particular, while the buttons 5 are arranged, in particular sewn, on a first side of the belt element 4 apt to face, in use, the user's body, the buttons 11 are arranged, in particular sewn, on a second side of the belt element 4 opposite the first side.

In practice, the buttons 5 are sewn onto an internal side of belt element 4 and the buttons 11 are sewn onto an external side thereof.

Conveniently, the eyelets 6 are selectively couplable with the buttons 5 or with the buttons 11 to determine two different superimposing positions of the end lateral portions 2*d*, 3*d* defining, respectively, the two configurations of the garment 1.

In greater detail, when the eyelets 6 are coupled to the buttons 5, the superimposing position shown in FIGS. 2 and 3 is determined and, thus, the configuration of the garment 1 shown in FIG. 1, wherein the rear sheet 2 wraps partially the front sheet 3 and the end lateral portions 2*d* are external and superimposed on the end lateral portions 3*d*.

On the contrary, when the eyelets 6 are coupled to the buttons 11, the superimposing position shown in FIGS. 5 to 9 is determined and, thus, the configuration of the garment 1 shown in FIG. 4, wherein the front sheet 3 wraps partially the rear sheet 2 and the end lateral portions 3*d* are external and superimposed on the end lateral portions 2*d*.

Figure 5:
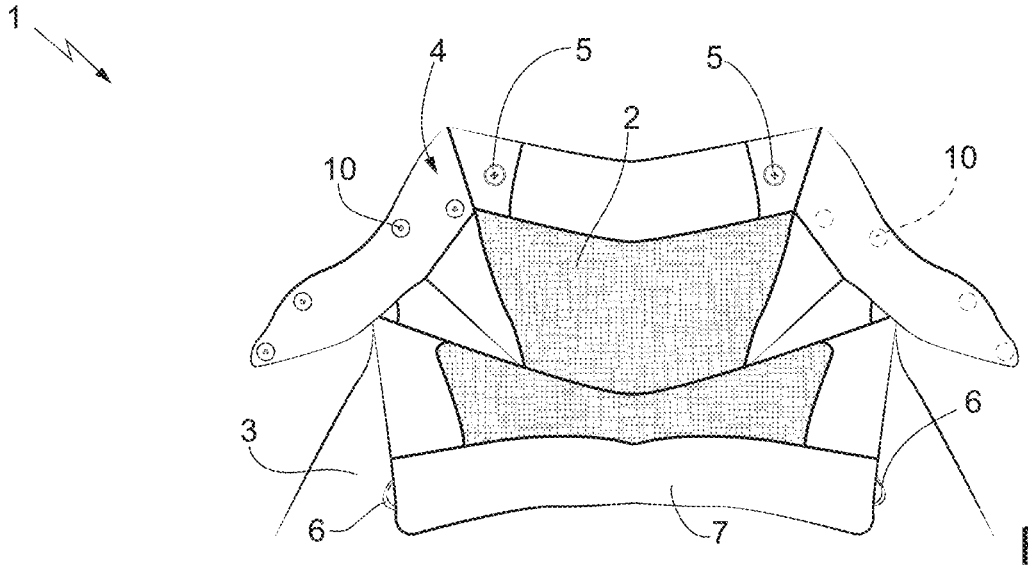
FIGS. 5 to 9 are frontal perspective views, with parts removed for clarity's sake, showing steps of a sequence of assembly of the convertible garment of FIG. 4.
Figure 6:
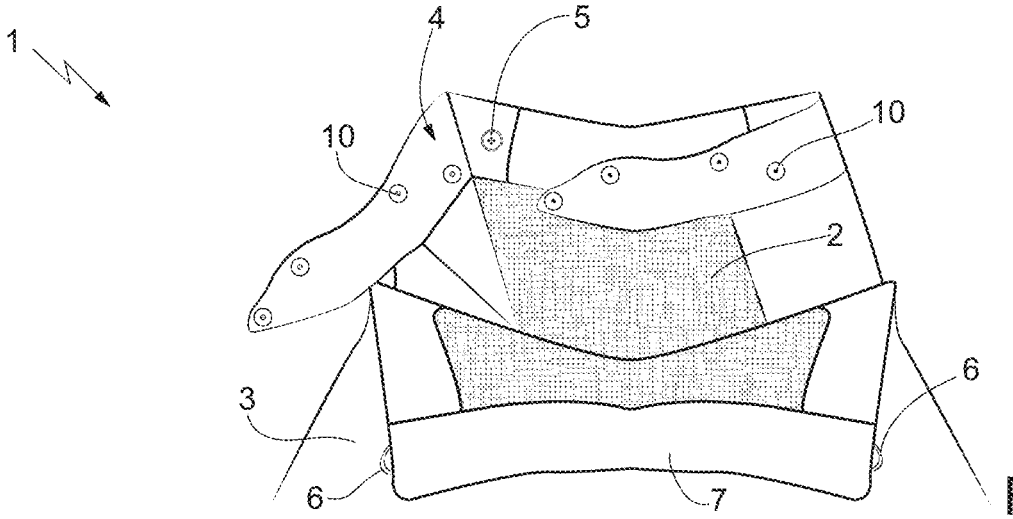
Figure 7:
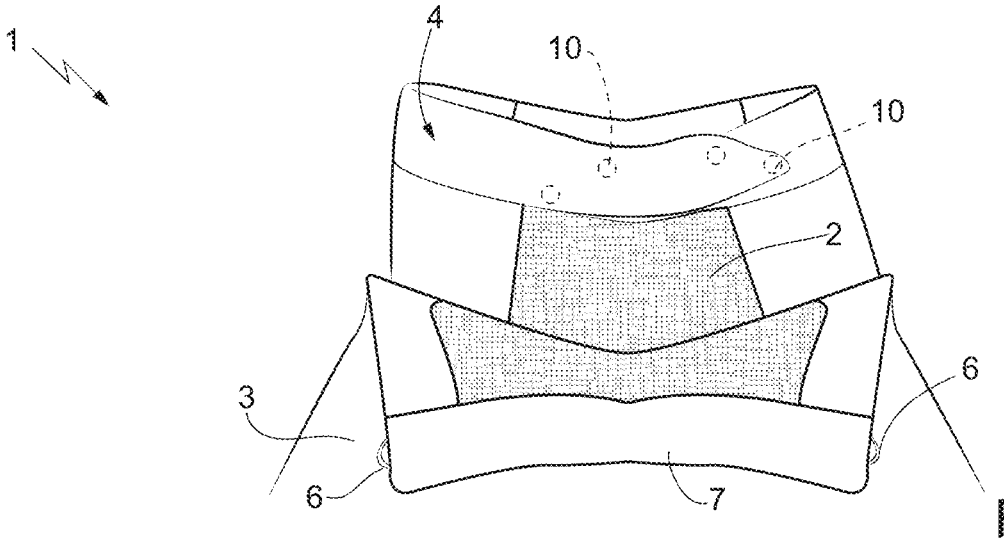

The sequence of assembly of the garment 1 in the configuration of FIG. 4 is shown in FIGS. 5 to 9: first of all, the belt element 4 is closed, by means of the fastening elements 10, so that it girds the designated portion of the user's body, for example the waist (FIGS. 5, 6 and 7)

Then, the front sheet 3 is superimposed onto the rear sheet 2 by coupling the eyelets 6 with the buttons 11 (FIGS. 8 and 9). FIG. 9*a* shows the detail of an eyelet 6 coupled to a button 11.

The end lateral portions 3*d* are thus superimposed on the end lateral portions 2*d*. They are decoupled from each other so as to define, similarly to what happens in the first configuration, lateral openings 3 of garment 1, i.e. the skirt.

According to an embodiment of the present invention, at least one of, preferably both, the rear sheet 2 and the front sheet 3 could be made according to a double-face pattern. For example, one or both of the rear sheet 2 and the front sheet 3 could have one side made of a first type of fabric and the opposite side of a second type of fabric different from the first one, or one side made according to a first weft and the opposite side made according a second weft different from the first one, or again one side in a first colour and the opposite side in a second colour different from the first one.

Figure 10:
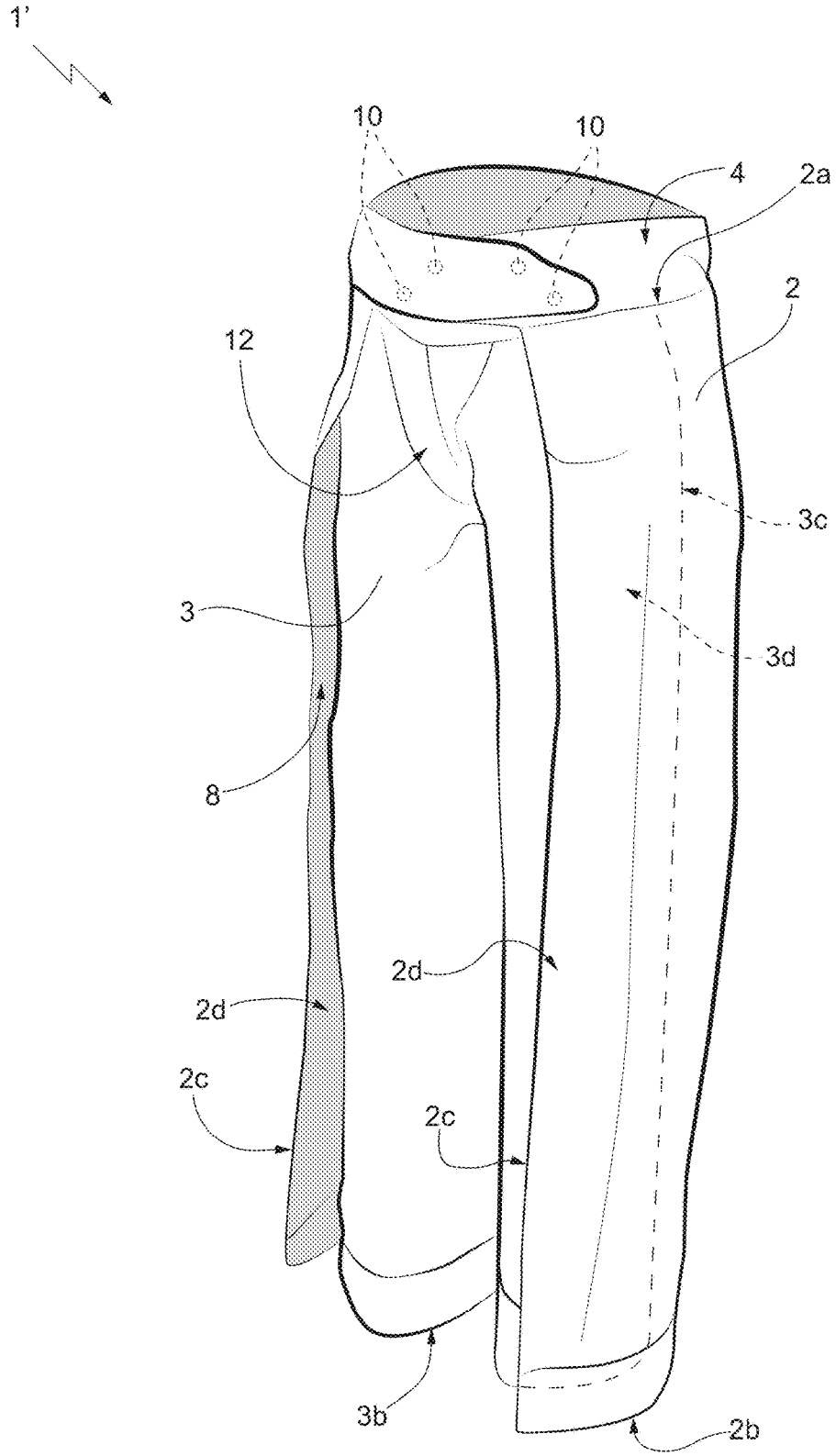
FIG. 10 is a perspective view of a convertible garment in accordance with a second embodiment of the present invention and arranged in a first configuration.

With reference to FIG. 10, a convertible garment made in accordance with a second embodiment of the present invention and arranged in a first configuration is referred to as 1' as a whole.

In particular, the garment 1' according to this embodiment are trousers.

As the garment 1' is substantially similar to the garment 1 in terms of function and structure, only the distinguishing features between the two will be highlighted below, indicating where possible corresponding or identical parts with the same references.

In particular, the garment 1' differs from the garment 1 in that the rear sheet 2 and the front sheet 3 are fixed, in particular sewn, to one another at least at portions thereof to define a crotch 12 of the garment 11.

Figure 11:
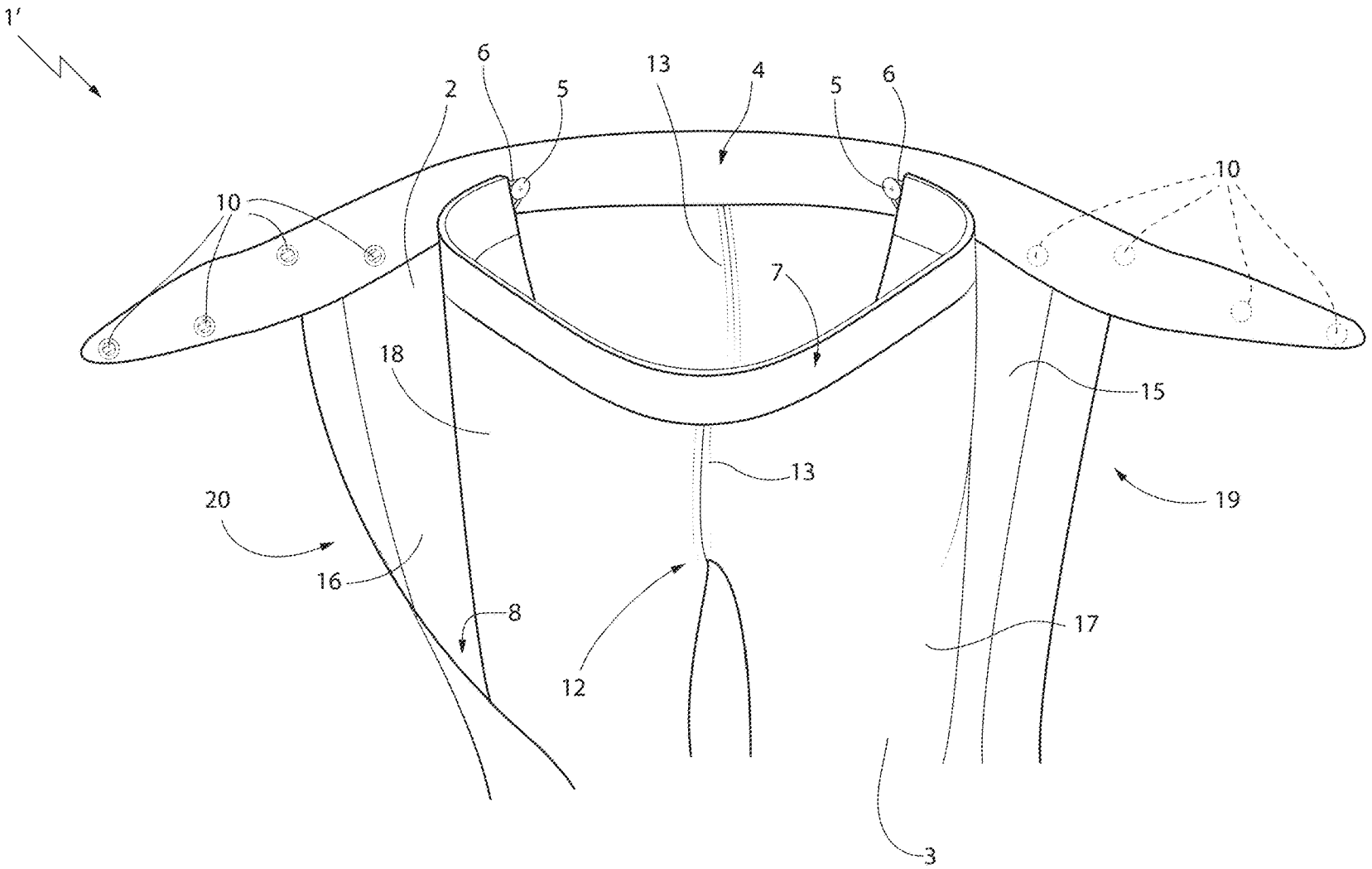
FIGS. 11 to 13 are front perspective views, with parts removed for clarity's sake, showing steps of a sequence of assembly of the convertible garment of FIG. 10.

This is particularly visible in FIG. 11, in which it is shown how the rear sheet 2 and the front sheet 3 are joined at the respective central portions 13 thereof to define the crotch 12 of the garment 1'.

Preferably, the rear sheet 2 and the front sheet 3 are composed of a single sheet.

Alternatively, the rear sheet 2 could be composed by joining, for example by sewing, a left rear half-sheet 15 and a right rear half-sheet 16. Similarly, the front sheet 3 could be composed by joining, for example by sewing, a left front half-sheet 17 and a right front half-sheer 18.

In one embodiment, the left rear half-sheet 15 and the left front half-sheet 17 are made as a single first sheet 19, and the right rear half-sheet 16 and the right front half-sheet 18 are made as a single second sheet 20. In this case, the first sheet 19 and the second sheet 20 are fixed, in particular sewn to one another at portions thereof to define the crotch 12 of the garment 1'.

Figure 12:
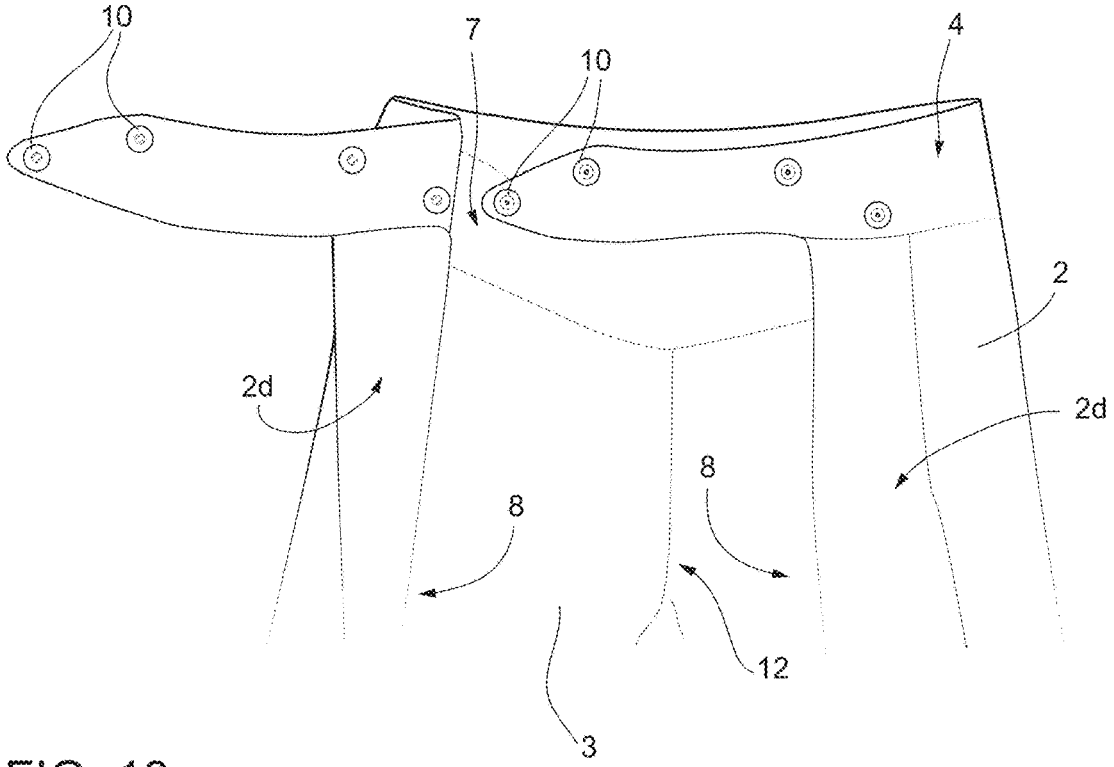
Figure 13:
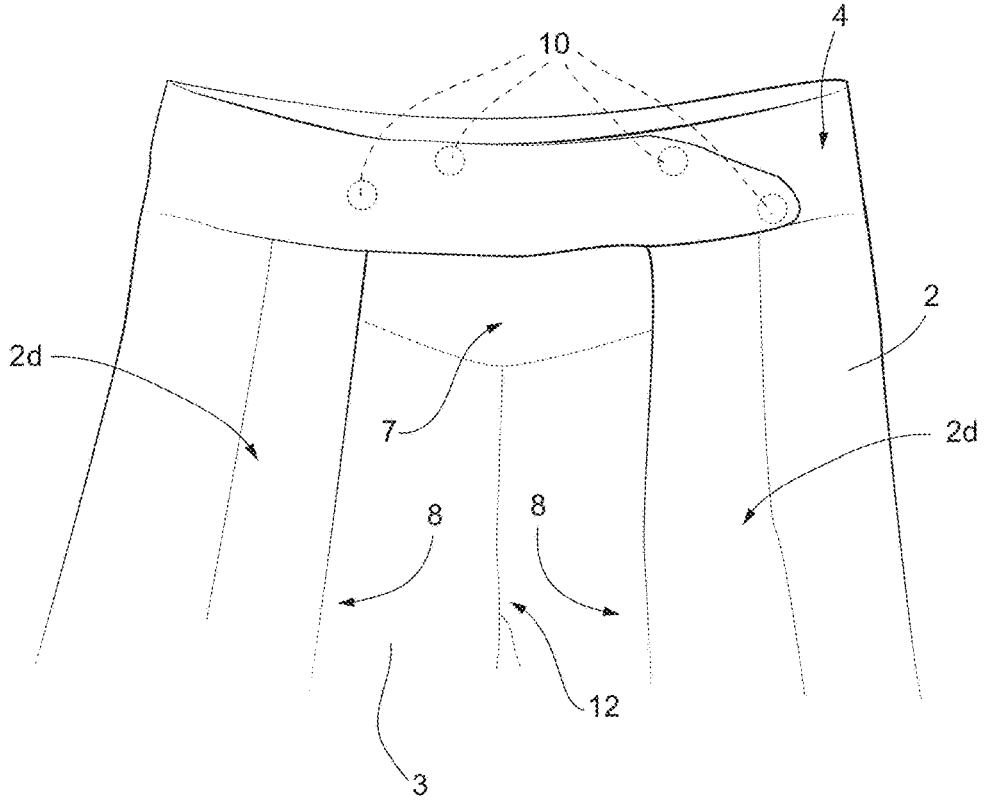

FIGS. 11, 12 and 13 show the assembly sequence of the garment 1' in the configuration of FIG. 10.

Unlike the skirt, in this case the front sheet 3 and the rear sheet 2 are already fixed to one other by means of crotch 12.

The eyelets 6 are coupled to the buttons 5, so as to determine the superposition of the end lateral portions 2*d* on the end lateral portions 3*d* (FIG. 11).

At this point, the belt element 4 is closed so as to obtain the configuration visible in FIG. 10, in which the rear sheet 2 wraps partially the front sheet 3 and in which the lateral openings 8 are defined, like in the case of the skirt (FIGS. 12 and 13).

Figure 14:
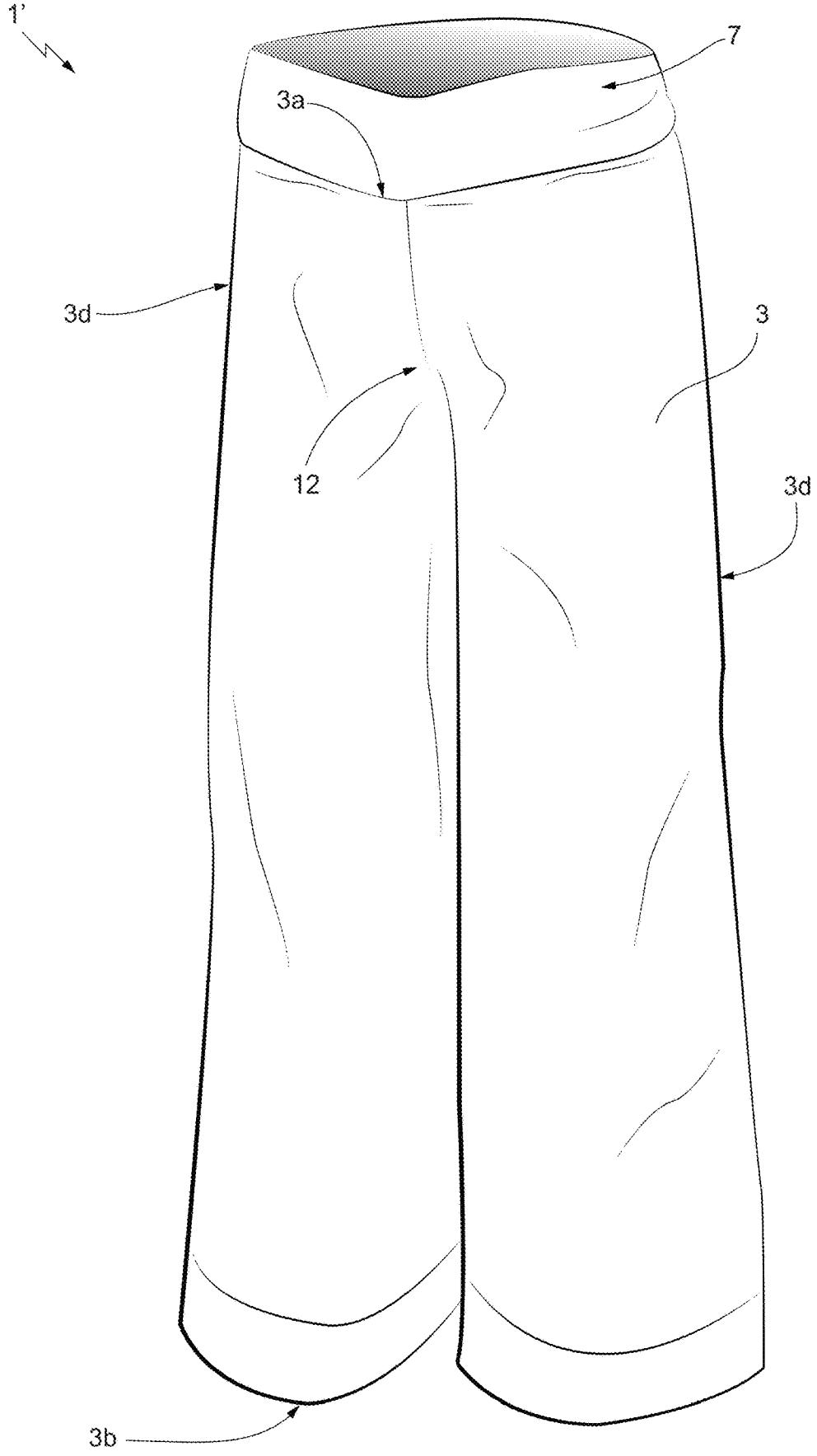
FIG. 14 is a perspective view of the convertible garment of FIG. 10 arranged in a second configuration.

FIG. 14 shows the garment 1' arranged in a second configuration different from the first one.

The assembly, in this case, is completely identical to that of the garment 1 in the configuration shown in FIG. 4.

Thus, also in this case, the eyelets 8 are coupled to the buttons 11 so that the front sheet 3 wraps partially the rear sheet 2 and the end lateral portions 3*d* are superimposed and external to the end lateral portions 2*d*.

From an examination of the characteristics of the garment 1, 1' made according to the present invention, the advantages that it allows obtaining are evident.

In particular, thanks to the configuration described above, it is possible to make a garment 1, 1', for example trousers or a skirt, minimizing the manufacturing operations, and in particular reducing the necessary seams to a minimum.

In addition, thanks to the modularity which characterises the above-described configuration, it is possible to replace, if necessary, only a part, i.e. only one of the sheet 2 and the front 3 sheets, of the convertible garment made according to the present invention, thus avoiding a replacement of the entire garment 1, 1'. This could also be advantageous in terms of the production of the garment 1, 1', as the production rate could be calibrated on the production needs of the single parts, independently of each other.

Furthermore, the convertible garment 1, 1' made according to the present invention is easily and quickly arrangeable in various configurations without having to laboriously couple together a plurality of parts and without having to repeatedly carry out sewing or unsewing.

In addition, the modularity of the garment 1, 1' has also been improved, since, given the ease with which the rear 2 and front 3 sheets are superimposed, it is possible to combine sheets made of different fabrics and/or weaves and/or colours between them.

Furthermore, since the rear 2 and the front 3 sheet could be made according to a double-face pattern, it is possible to further increase the number of combinations and configurations in which the garment 1, 1' according to the present invention can be arranged. This also leads to an increase in the interchangeability of the parts making up the garment 1, 1'.

It is clear that the garment 1, 1' described and shown herein may be subject to modifications and variations without thereby departing from the scope of protection defined by the claims.

In particular, the garment 1, 1' could be defined by a top. In this case, the belt element 4 girds the user's chest and the garment extends along the user's body up to the waist or slightly above or below.

Alternatively, the garment 1, 1' could be defined by a dress, wherein the belt element 4 girds the user's neck, or a portion of the body above or below the user's breast, and which extends up to below the waist, for example at knee or ankle height.

The invention claimed is:

1. Convertible garment (1; 1') configured to cover at least part of a user's body and comprising:

a shaped rear sheet (2) and a shaped front sheet (3) superimposable onto one another to define a configuration of the garment (1; 1') and each delimited by a lower edge (2*b*, 3*b*), by an upper edge (2*a*, 3*a*) and by two lateral edges (2*c*, 3*c*) interposed between the lower edge (2*b*, 3*b*) and the upper edge (2*a*, 3*a*);

a belt element (4) sewn to the upper edge (2*a*) of the rear sheet (2) and configured to gird a portion of the user's body, the belt element (4) comprising releasable closing elements (10) configured to releasably fix the belt element (4) in a closing condition of said belt element (4);

first fastening elements (5) carried by the belt element (4); and second fastening elements (6) carried by the front sheet (3) and couplable with the first fastening elements (5) to determine a superimposition position between end lateral portions (2*d*) of the rear sheet (2) and corresponding end lateral portions (3*d*) of the front sheet (3), each carrying one respective said lateral edge (2*c*, 3*c*);

wherein the second fastening elements (6) are carried by a further belt element (7) sewn to the upper edge (3*a*) of the front sheet (3) and configured to gird the portion of the user's body;

wherein the superimposed end lateral portions (2*d*, 3*d*) define respective lateral openings (8) of said garment (1; 1');

wherein, at least in the closing condition of said belt element (4), said superimposed end lateral portions (2*d*, 3*d*) are decoupled from one another so as to delimit said lateral openings (8) along a longitudinal direction of said garment (1; 1');

wherein the convertible garment comprises third fastening elements (11) carried by said belt element (4);

wherein said second fastening elements (6) are selectively couplable with the first fastening elements (5) or with the third fastening elements (11) to determine two different superimposition positions of said end lateral portions (2*d*, 3*d*) defining, respectively, two configurations of said garment (1; 1') different from one another, the releasable closing elements (10) providing no effect on the determination of the two different superimposition positions wherein, in one of said two superimposition positions, the rear sheet (2) wraps at least partially the front sheet (3) so that the end lateral portions (2*d*) of the rear sheet (2) are external relative to the end lateral portions (3*d*) of the front sheet (3);

and wherein, in the other of said two superimposition positions, the front sheet (3) wraps at least partially the rear sheet (2) so that the end lateral portions (2*d*) of the rear sheet (2) are internal relative to the end lateral portions (3*d*) of the front sheet (3).

2. Convertible garment as claimed in claim 1, wherein said first fastening elements (5) are arranged on a first side of the belt element (4) apt to face, in use, the user's body, and wherein said third fastening elements (11) are arranged on a second side of the belt element (4) opposite the first side;

wherein, by coupling said second fastening elements (6) to said first fastening elements (5), said one of said two superimposition positions is determined, and wherein, by coupling said second fastening elements (6) with said third fastening elements (11), said other of said two superimposition positions is determined.

3. Convertible garment (1') as claimed in claim 1, wherein the rear sheet (2) and the front sheet (3) are sewn to one another at least at portions (13) thereof to define a crotch (12) of said garment (1').

* * * * *